US006766940B2

(12) United States Patent
Negelen

(10) Patent No.: US 6,766,940 B2
(45) Date of Patent: Jul. 27, 2004

(54) HANDLE ARRANGMENT FOR A CARTON

(75) Inventor: Emanuel Negelen, Schweich (DE)

(73) Assignee: Graphic Packaging International, Inc., Marietta, GA (US)

( * ) Notice: Subject to any disclaimer, the term of this patent is extended or adjusted under 35 U.S.C. 154(b) by 0 days.

(21) Appl. No.: 10/204,240

(22) PCT Filed: Feb. 28, 2001

(86) PCT No.: PCT/GB01/00841

§ 371 (c)(1),
(2), (4) Date: Nov. 25, 2002

(87) PCT Pub. No.: WO01/66434

PCT Pub. Date: Sep. 13, 2001

(65) Prior Publication Data

US 2003/0136820 A1 Jul. 24, 2003

(30) Foreign Application Priority Data

Mar. 7, 2000 (GB) ..... 0005317
Jun. 10, 2000 (GB) ..... 0014131

(51) Int. Cl.[7] ..... B65D 5/468
(52) U.S. Cl. ..... 229/117.13; 206/427; 229/103.2
(58) Field of Search ..... 229/103.2, 117.13; 206/181, 427

(56) References Cited

U.S. PATENT DOCUMENTS 2,372,351 A 3/1945 Arneson
2,851,210 A * 9/1958 Kramer et al. ..... 206/141
3,994,432 A * 11/1976 Kirby, Jr. ..... 206/141
4,447,004 A * 5/1984 House et al. ..... 229/117.13
4,498,581 A * 2/1985 Dutcher ..... 206/427
4,838,479 A * 6/1989 Wood ..... 229/117.13
5,197,598 A * 3/1993 Stout et al. ..... 206/141
5,246,112 A * 9/1993 Stout et al. ..... 206/427
5,482,203 A * 1/1996 Stout ..... 206/141
5,639,017 A * 6/1997 Fogle ..... 229/117.13
5,704,470 A * 1/1998 Sutherland ..... 206/427
5,738,273 A * 4/1998 Auclair ..... 229/103.2
6,065,590 A * 5/2000 Spivey ..... 206/427

FOREIGN PATENT DOCUMENTS

DE 296 13 814 U1 8/1996 ..... B65D/75/18
WO WO 96/21604 7/1996 ..... B65D/71/32
WO WO 98/19932 5/1998 ..... B65D/71/36

* cited by examiner

*Primary Examiner*—Gary E. Elkins
(74) *Attorney, Agent, or Firm*—Womble Carlyle Sandridge & Rice, PLLC

(57) ABSTRACT

A paperboard carton is disclosed that has a base with first and second top panels. The first top panel incorporates a pair of spaced slots and secondary end panels hingedly connected to opposite side edges. The secondary end panels are folded against and adhesively secured to the first top panel. The second top panel is folded over and adhered to the secondary end panels to provide reinforcement for the top while enabling access to a handle formed in the first top panel.

8 Claims, 3 Drawing Sheets

HANDLE ARRANGMENT FOR A CARTON

This application claims priority under 35 U.S.C. §119 (b) to British application, ser. No. 0005317.3, filed on Mar. 7, 2000 and British application, ser. No. 0014131.7, filed on Jun. 10, 2000 and PCT application, ser. No. PCT/GB01/00841, filed on Feb. 28, 2001 under 35 U.S.C. §363.

BACKGROUND OF THE INVENTION

This invention relates to a carton having a handle.

SUMMARY OF THE INVENTION

According to the present invention there is provided a paperboard carton having a base, first and second side panels hingedly connected to opposite side edges of the base, first and second top panels hingedly connected to the first and second side panels respectively, one or more parts of said first top panel defining handle means and the first top panel having secondary end panels hingedly connected thereto wherein the secondary end panels are folded against and adhesively secured to the first top panel and the second top panel overlies the first top panel and secondary end panels combination and is adhesively secured thereto, said second top panel enabling access to the handle means of the first top panel.

Preferably said one or more parts of said first top panel comprise one or more openings and said secondary end panels have cooperating cut-away portions. Ideally said one or more parts comprise a pair of spaced, lengthwise extending slots. In preferred arrangements the second top panel has apertures which overlie said slots and the secondary end panels are shaped so as to keep the slots exposed when secured to the first top panel.

It is a preferred feature that the hinge connections between the secondary end panels and the first top panel incorporate relieved areas. Conveniently each hinge connection comprises two spaced hinge portions located adjacent respective side edges of the first top panel.

In preferred embodiments, base end panels and top end panels are hingedly connected to the base end second top panels respectively and the first and second side panels have at each of their lengthwise edges end panels hingedly connected thereto, the base and top end panels overlying the side end panels at each end and being adhesively secured thereto and to each other. Normally the secondary end panels are adhesively secured to the top of the first top panel and the second top panel is adhesively secured to the secondary end panels.

BRIEF DESCRIPTION OF THE DRAWINGS

Embodiments of the present invention will now be described in more detail. The description makes reference to the accompanying drawings in which.

DETAILED DESCRIPTION

Figure 1:
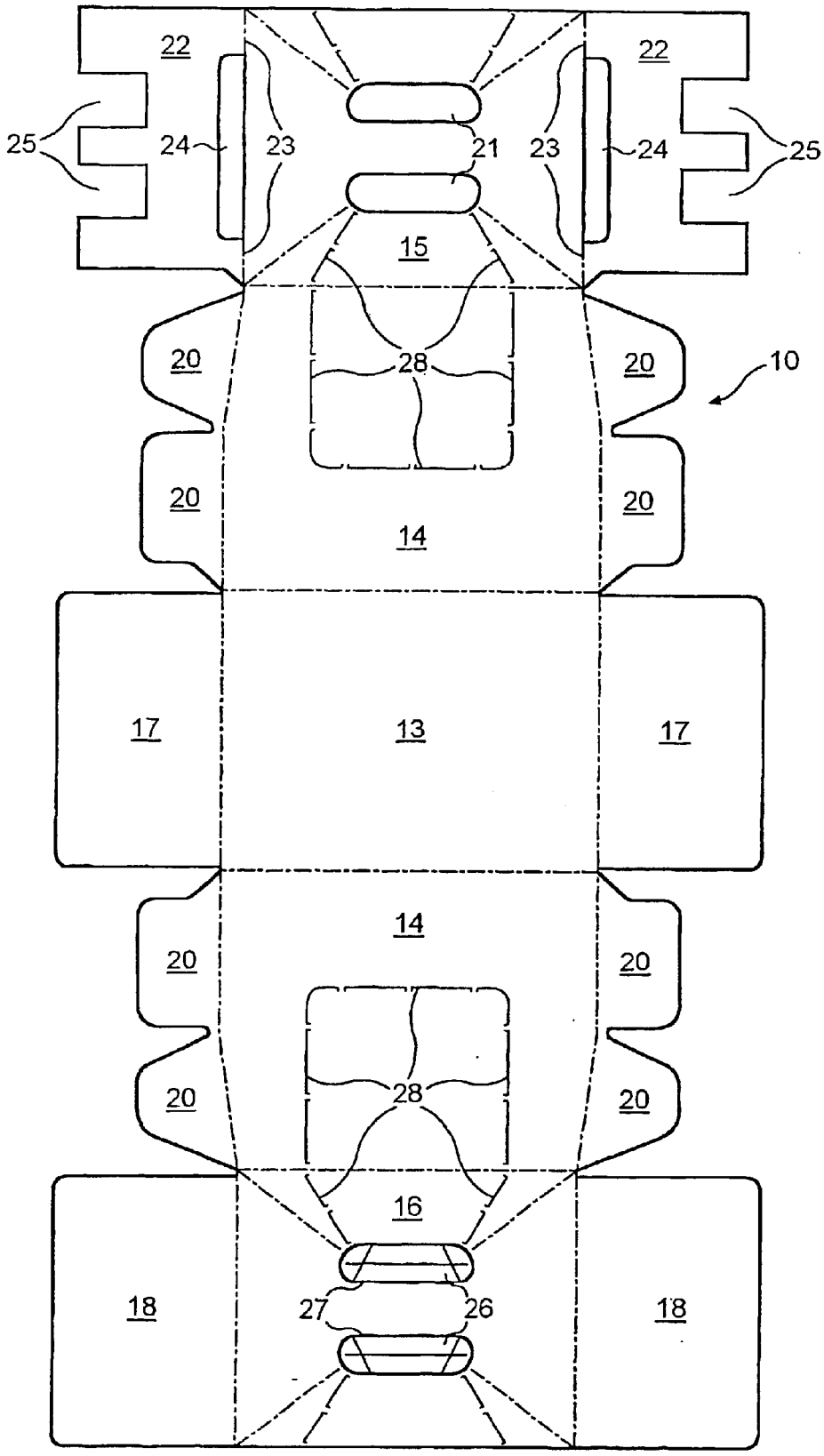
FIG. 1 shows a blank for producing a carton according to the present invention.
Figure 2:
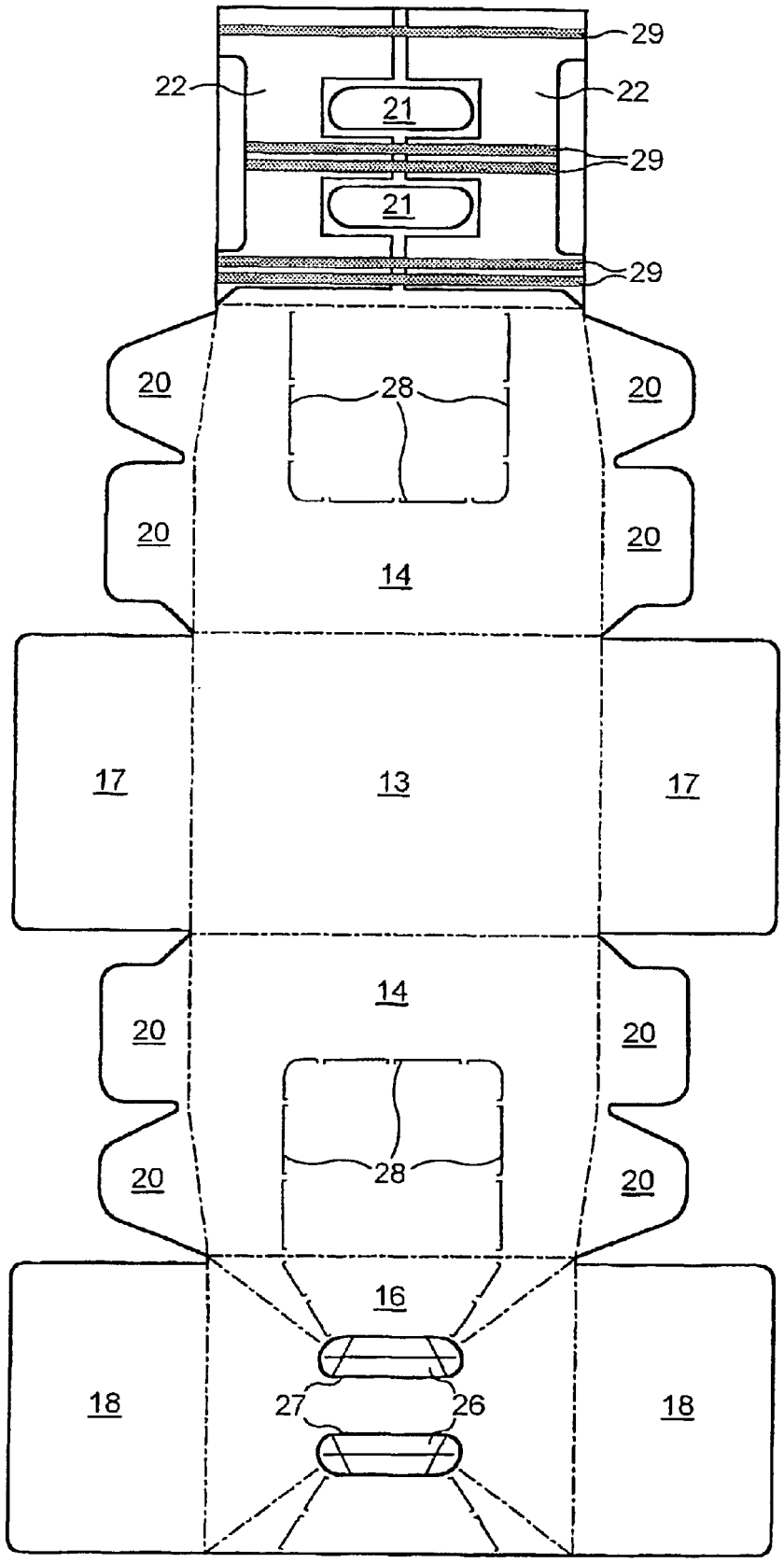
FIG. 2 shows the FIG. 1 blank in an early stage of assembly.
Figure 3:
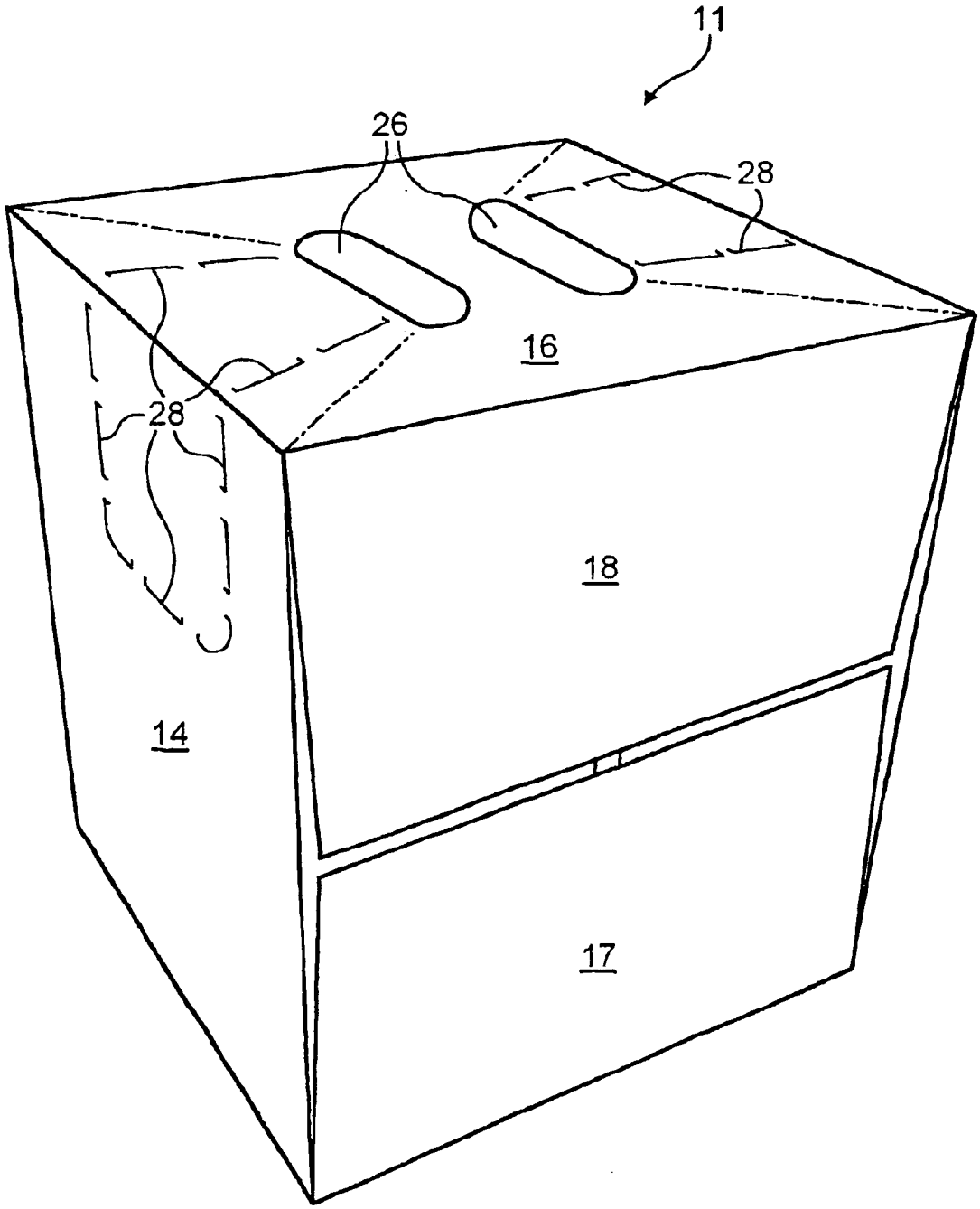
FIG. 3 is a perspective view of an assembled carton without tapering side walls.

In FIGS. 1 to 3 there is shown a blank 10 which when constructed forms a carton 11 for a plurality of articles such as bottles (not shown). In this embodiment twelve bottles are to be contained in three rows of four bottles but the blank could easily be adapted for any number of bottles, cans or other articles.

The blank 10 has a base 13, side panels 14 hingedly connected thereto and first and second top panels 15, 16 hingedly connected to respective opposite side panels 14. The hinge connections could be by simple fold lines, partially cut fold lines or other suitable means. The base 13 has base end panels 17 which in use are folded up and the second top panel 16 has hingedly connected top end panels 18, which when assembled are folded down. Hingedly connected to the side panels 14 are end closure panels 20 which are folded inwardly and are adhesively secured to the end panels 17, 18 so as to fully enclose the ends of the carton 11.

The first top panel 15 incorporates a pair of spaced slots 21 which define handle means. The slots 21 are located such that the handle means is located centrally between the two side panels 14. At each end of the top panel 15, cut away portions 24 are included between the hinges 23 to facilitate folding of the hinges 23. The secondary end panels 22 have cut-away portions 25 which cooperate with the slots in the first top panel when the panels are folded together.

The second top panel 16 has push-in flaps 26 hingedly connected at 27. When the flaps are pushed in, apertures are formed.

Lines of weakening 28 are provided in the first and second top panels 15, 16 and in the side panels 14 and where the top panels 15, 16 overlap the lines of weakening 28 are aligned. The lines of weakening 28 allow the consumer to open the carton with ease so as to gain access to the contents of the carton. Other configurations are of course possible for the lines of weakening and they could also be omitted on one or both sides of the handle if desired.

Assembly of the carton 11 is as follows. The secondary end panels 22 are glued and folded on to the top of the first top panel 15. The twelve bottles in this instance are positioned on the base 13 and the side walls 14 are folded up. The first top panel 15 and secondary end panels 22 are folded over the tops of the bottles and adhesive is applied to areas 29 of the secondary top panels 22 as shown in FIG. 2. The second top panel 16 is then folded over and adhered to the secondary end panels such that the flaps 26 overlie the cut-away portions 25.

The end closure flaps 20 are folded inwardly, the base end panel 17 is folded upwardly to be secured to the lower end closure flaps 20, and the top end panels 18 are then folded to be secured to the base end panel and upper end closure flaps 20 so as to close off the ends of the carton which is thus fully enclosed.

To pick up the carton 11, the flaps 26 are pushed in through the aligned cut-away portions 25 and slots 21 and can be folded under the area between the slots 21. The secondary end panels 22 provide reinforcement for the top of the carton 11, but are formed from an area of paperboard which would normally be wasted.

The carton could of course be varied in a number of ways such as size and shape of the carton, handle, areas of weakening.

What is claimed is:

1. A paperboard carton having abase, first and second side panels hingedly connected to opposite side edges of the base, first and second top panels hingedly connected to the first and second side panels respectively, one or more parts of said first top panel defining a handle and the first top panel having secondary end panels hingedly connected thereto wherein the secondary end panels arc folded against and adhesively secured to the first top panel and the second top panel overlies the first top panel and secondary end panels combination and is adhesively secured thereto, said second top panel enabling access to the handle means of the first top panel.

2. A carton as claimed in claim 1 wherein said one or more parts of said first top panel comprise one or more openings and said secondary end panels have cooperating cut-away portions.

3. A carton as claimed in claim 2 wherein said one or more parts comprise a pair of spaced, lengthwise extending slots.

4. A carton as claimed in claim 3 wherein the second top panel has apertures which overlie said slots and the secondary end panels are shaped so as to keep the slots exposed when secured to the first top panel.

5. A carton as claimed in claim 1 wherein the hinge connections between the secondary end panels and the first top panel incorporate relieved areas.

6. A carton as claimed in claim 1 wherein each hinge connection comprises two spaced binge portions located adjacent respective side edges of the first top panel.

7. A carton as claimed in claim 1 wherein base end panels and top end panels are hingedly connected to the base and the second top panels respectively and the first and second side panels have at each of their lengthwise edges end panels hingedly connected thereto, the base and top end panels overlying the side end panels at each end and being adhesively secured thereto and to each other.

8. A carton as claimed in claim 7 wherein the secondary end panels are adhesively secured to the top of the first top panel and the second top panel is adhesively secured to the secondary end panels.

* * * * *

UNITED STATES PATENT AND TRADEMARK OFFICE

CERTIFICATE OF CORRECTION

PATENT NO. : 6,766,940 B2
DATED : July 27, 2004
INVENTOR(S) : Emanuel Negelen

It is certified that error appears in the above-identified patent and that said Letters Patent is hereby corrected as shown below:

Column 2,
Line 61, delete “abase” and insert -- a base --
Line 67, delete “arc” and insert -- are --

Signed and Sealed this

Twelfth Day of July, 2005

JON W. DUDAS
*Director of the United States Patent and Trademark Office*